US005618042A

United States Patent [19]

Takemoto et al.

[11] Patent Number: 5,618,042

[45] Date of Patent: Apr. 8, 1997

[54] MEDAL DISTRIBUTION SYSTEM IN A SLOT MACHINE ISLAND

[75] Inventors: Takatoshi Takemoto; Yoichi Yoneda, both of Tokyo; Meiji Muramatsu, Yokohama, all of Japan

[73] Assignee: Kabushiki Kaisha Ace Denken, Tokyo, Japan

[21] Appl. No.: 313,061

[22] PCT Filed: Mar. 24, 1993

[86] PCT No.: PCT/JP93/00346

§ 371 Date: Sep. 26, 1994

§ 102(e) Date: Sep. 26, 1994

[87] PCT Pub. No.: WO93/18828

PCT Pub. Date: Sep. 30, 1993

[30] Foreign Application Priority Data

Mar. 26, 1992 [JP] Japan ..... 4-068736
Mar. 26, 1992 [JP] Japan ..... 4-068738

[51] Int. Cl.[6] ..... A63F 5/04; C07D 9/00

[52] U.S. Cl. ..... 273/143 R; 463/20; 193/DIG. 1

[58] Field of Search ..... 273/138 A, 143 R, 273/121 B; 194/344; 193/14, 23, 25 R, 25 S, DIG. 1; 463/20

[56] References Cited

U.S. PATENT DOCUMENTS 745,671 12/1903 Roby ..... 193/25 S
4,342,384 8/1982 Fukase et al. .

FOREIGN PATENT DOCUMENTS 61-16186 1/1986 Japan .
63-88694 4/1988 Japan .
2-84983 3/1990 Japan .
2-74092 6/1990 Japan .
3-149066 6/1991 Japan .
3-155884 7/1991 Japan .
1393179 5/1975 United Kingdom .

*Primary Examiner*—Jessica Harrison
*Assistant Examiner*—James Schaaf
*Attorney, Agent, or Firm*—Lowe, Price, LeBlanc & Becker

[57] ABSTRACT

A medal distribution system placed in a slot machine island (100) for distributing medals to a plurality of sections in the island. The distribution system comprises a conveyance line (130) being disposed along a row of slot machines for transporting medals in a row direction of the slot machines and a distribution mechanism (200) for extracting medals transported on the conveyance line from the conveyance line. The distribution mechanism (200) has a frame (4) having a plurality of discharge openings being formed on a side face of the conveyance line for extracting medals transported on the conveyance line from the line to the side, a plurality of guide mechanisms (3) being attached to the frame for leading medals on the line to an outside through the discharge openings, and a plurality of supply passages (9) for guiding medals discharged through the discharge openings to target sections.

8 Claims, 8 Drawing Sheets

MEDAL DISTRIBUTION SYSTEM IN A SLOT MACHINE ISLAND

FIELD OF THE INVENTION

This invention relates to a medal distribution system in a slot machine island for distributing medals transported on a supplying belt conveyor to slot machines and medal lending machines.

BACKGROUND OF THE INVENTION

Slot machines are grouped and each group of slot machines is placed like an island in a gaming house. The group of slot machines thus arranged is called a slot machine island. In addition to the slot machines, a plurality of medal lending machines for lending medals are located in the slot machine island. The medal lending machines are placed between the slot machines in the slot machine island and/or at least on one end of a row of slot machines.

The slot machine island is provided with a medal distribution system for distributing medals to the slot machines and the medal lending machines.

A conventional medal distribution system in a slot machine island is described in Japanese Utility Model Laid-Open No. Sho 61-16186, for example. The medal distribution system has a supplying belt conveyor disposed in the upper portion of the slot machine island, a plurality of distributors located along the course of the belt conveyor, and supply passages each disposed between each distributor and its corresponding slot machine or medal lending machine. The system transports medals in the horizontal direction via the supplying belt conveyor and distributes the medals by means of the distributors so as to supply the medals to the slot machines and the medal lending machines via the separate supply passages.

Whenever medal distribution becomes necessary, the medal distribution system selects and operates a corresponding one of the distributors, each of which is installed for each slot machine or medal lending machine, in response to the necessity arising for the medal distribution, thereby dropping the medals into the supply passage connected to the slot machine or medal lending machine requiring medal, for distribution.

However, the conventional distribution system is equipped with only as many distributors as the number of slot machines and medal lending machines to which the medals are to be distributed. The distributors are fixed to their respective installation places.

Therefore, the connection positions of the supply passages are uniquely determined; in such a distribution system, the locations of supply passages (disposition route) are extremely limited. As a result, it is difficult to avoid interference with other devices in the slot machine island when disposing the supply passages. Thus, the structure becomes complicated and design is not easy. When the slot machines, etc., are assembled, assembling of the slot machine island is not easy because of the complicated structure. In addition, modification or design change of the slot machine island cannot be carried out easily.

On the other hand, in the conventional medal distribution system, the supply passages are provided with flexibility so that interference with other devices, etc., can be avoided as much as possible and so that the supply passages can be disposed easily. That is, in the distribution system, each of the supply passages is formed so as to have a rectangular section by winding a filament in a spiral fashion, so as to provide flexibility.

However, in the supply passage of such a structure (concertinaed gutter), medals do not flow smoothly, and the distribution system may be unable to demonstrate its function sufficiently, because a medal is easily caught in a gap between coils making up the supply passage. If medals are discharged from a discharge port by the operation of the distributor, the medals may not flow down into the slot machine, etc., smoothly. Particularly, if the concertinaed gutter is disposed windingly and the gap spreads partially, a medal can easily be inserted in the gap. Thus, in the worst case, a plurality of medals may be caught in the gap, blocking the passage, namely, a so-called bridge phenomenon may occur.

SUMMARY OF THE INVENTION

It is a first object of the invention to provide a medal distribution system in a slot machine island having high adaptability of the disposition of supply passages. It is a second object of the invention to provide a medal distribution system in a slot machine island for causing medals to smoothly flow along supply passages while maintaining flexibility of the supply passages.

To accomplish the first object of the invention, according to a first form of the invention, there is provided a medal distribution system placed in a slot machine island where a plurality of slot machines are arranged in a row for distributing medals to a plurality of sections in the island, the medal distribution system comprising:

- a conveyance line being disposed along the row of slot machines for transporting medals in a row direction of the slot machines; and
- a distribution mechanism for extracting medals transported on the conveyance line from the conveyance line, the distribution mechanism having:

- a frame having a plurality of discharge openings being formed on a side face of the conveyance line for extracting medals transported on the conveyance line from the line to the side;
- a plurality of guide mechanisms being attached to the frame for leading medals on the line to the outside through the discharge openings; and
- a plurality of supply passages for guiding medals discharged through the discharge openings to target sections, wherein the frame has a greater number of the discharge openings than the number that are actually used for distributing medals, along a transport direction of the conveyance line.

To accomplish the second object of the invention, according to a second form of the invention, there is provided a medal distribution system placed in a slot machine island where a plurality of slot machines are arranged in a row for distributing medals to a plurality of sections in the island, the medal distribution system comprising:

- a conveyance line being disposed along the row of slot machines for transporting medals in a row direction of the slot machines; and
- a distribution mechanism for extracting medals transported on the conveyance line from the conveyance line, the distribution mechanism having:

a frame having a plurality of discharge openings being formed on a side face of the conveyance line for extracting medals transported on the conveyance line from the line to the side;

a plurality of guide mechanisms being attached to the frame for leading medals on the line to the outside through the discharge openings; and a plurality of supply passages for guiding medals discharged through the discharge openings to target sections, the supply passages being made of a flexible tubular substance.

When one of the guide mechanisms operates, medals transported in the horizontal direction on the conveyance line on the top of the slot machine island are discharged through the discharge opening for which the guide mechanism is provided. The medals drop within the supply passage connected to the discharge opening for supply to a specific slot machine or medal lending machine.

Therefore, medals can be supplied for distribution to a predetermined slot machine or medal lending machine at the appropriate time by operating a predetermined one of the guide mechanisms at the appropriate time. There are provided a greater number of discharge openings than the number of distribution sections, such as the slot machines. Therefore, the installation positions of the guide mechanisms and the supply passages can be changed by mounting them detachably on the discharge openings; the flexibility of the locations of the supply passages becomes extremely high.

In the second form of the invention, the supply passages are made of a flexible tubular substance, whereby discharged medals drop smoothly within the supply passages, preventing the medals from being caught in midpoints along the passages or a jam or a bridge phenomenon from occurring.

According to the medal distribution system in the slot machine island according to the invention, the installation positions of the guide mechanism and the supply passage can be shifted, and the flexibility of the locations of the supply passages becomes extremely high. Thus, it becomes easy to avoid interference with other devices in the slot machine island for disposing the supply passages; assembly of the slot machine island becomes easy and modification or design change of the slot machine island is facilitated.

According to the medal distribution system in the slot machine island according to the invention, while flexibility of the supply passages is maintained, a flow of medals in the supply passages becomes extremely smooth. Thus, while adaptability of the disposition of the supply passages is maintained, smooth and secure medal distribution is enabled. In addition, the medal distribution system also has the capability of ejecting foreign substance to the outside through the meshes of the filaments making up the supply passages and has an advantage of enabling the operator to check on the medal flow from the outside.

DESCRIPTION OF THE PREFERRED EMBODIMENTS

Referring now to the accompanying drawings, there are shown preferred embodiments of the invention.

Figure 1A:
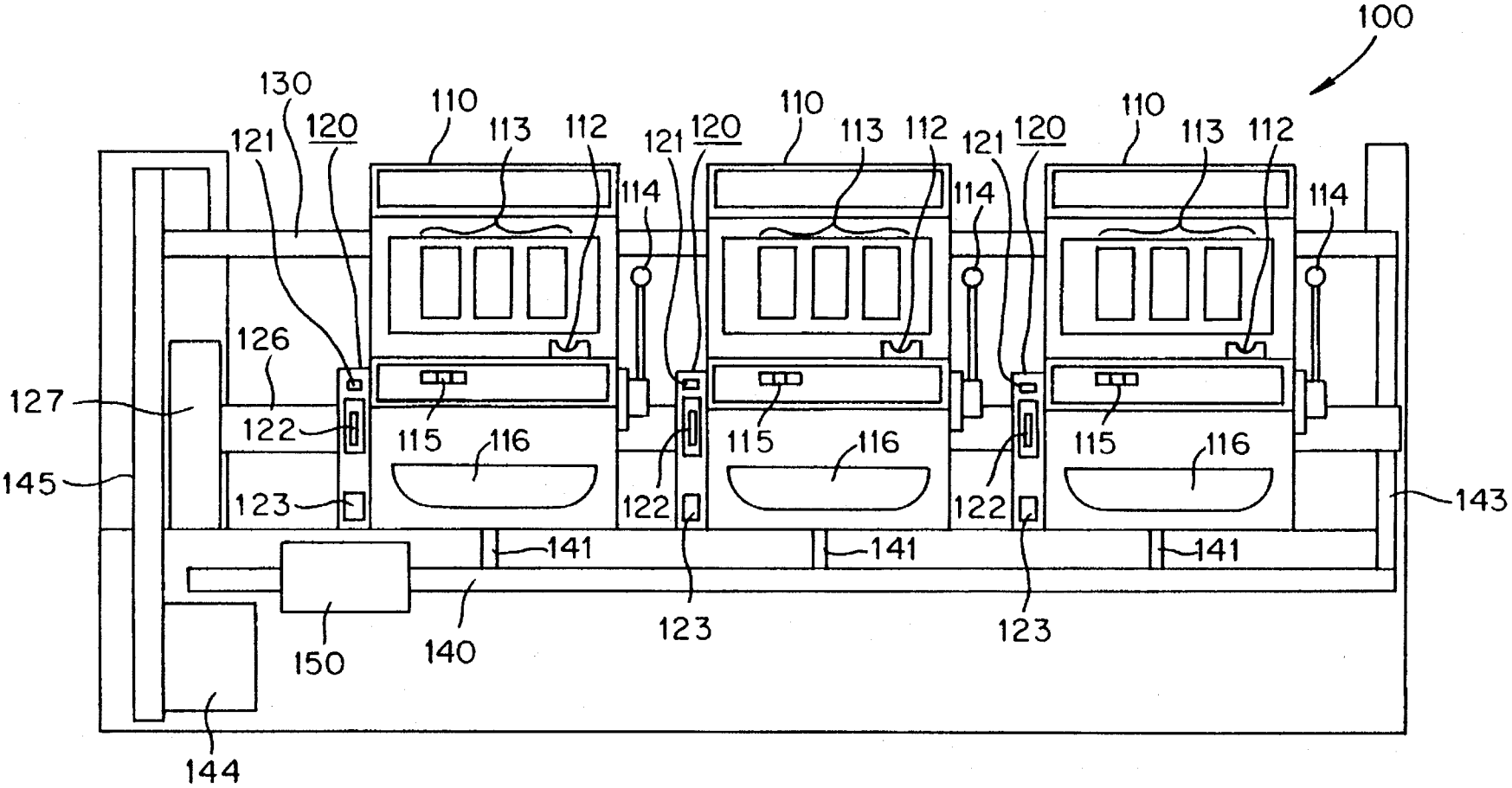
FIG. 1A is a front view showing a schematic configuration of a slot machine island to which a medal distribution system of the invention is applied.

FIG. 1A shows a schematic configuration of one example of a slot machine island to which the invention is applied.

The slot machine island 100 shown in FIG. 1A comprises a plurality of slot machines 110, a conveyance line 130 for conveying medals, a bill transporter 126 for transporting bills, and a medal collection conveyor 140 for collecting medals input to the slot machines, disposed along the length of the slot machine island 100. The conveyance line 130 is provided with a distribution system for distributing medals to the slot machines 110, as described below.

Installed on one end of the slot machine island 100 are a medal tank 144 for storing medals, a lifter 145 for lifting up medals stored in the medal tank 144 to the conveyance line 130, and a stacker 127 for storing bills transported by the bill transporter 126.

Further, located on the other end of the slot machine island 100 is a termination overflow passage 143 for collecting overflowing medals at the termination of the conveyance line 130.

The medal collection conveyor 140 is communicated with gaming machine overflow passages 141 for guiding medals overflowing from the slot machines 110 to the medal collection conveyor 140 and the termination overflow passage 143. A medal cleaner 150 for cleaning medals is installed near the termination of the medal collection conveyor 140. The termination of the medal collection conveyor 140 reaches the medal tank 144 for sending medals discharged from the medal cleaner 150 to the medal tank 144.

Figure 1B:
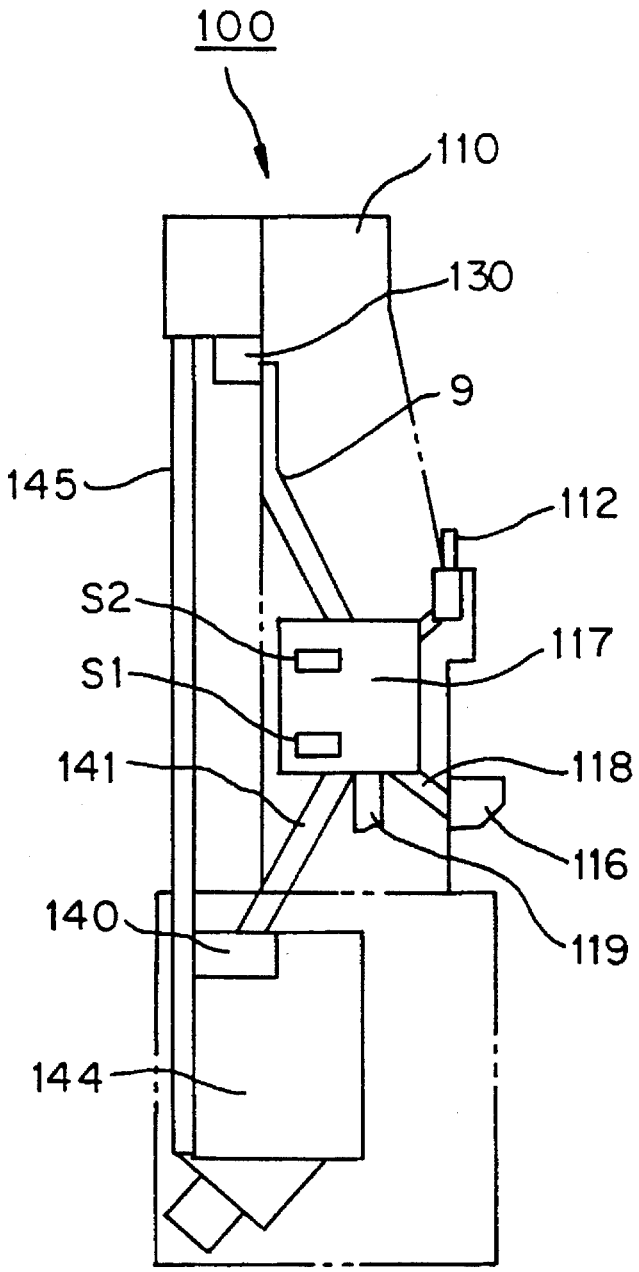
FIG. 1B is an illustration showing a vertical moving path of medals.
Figure 1C:
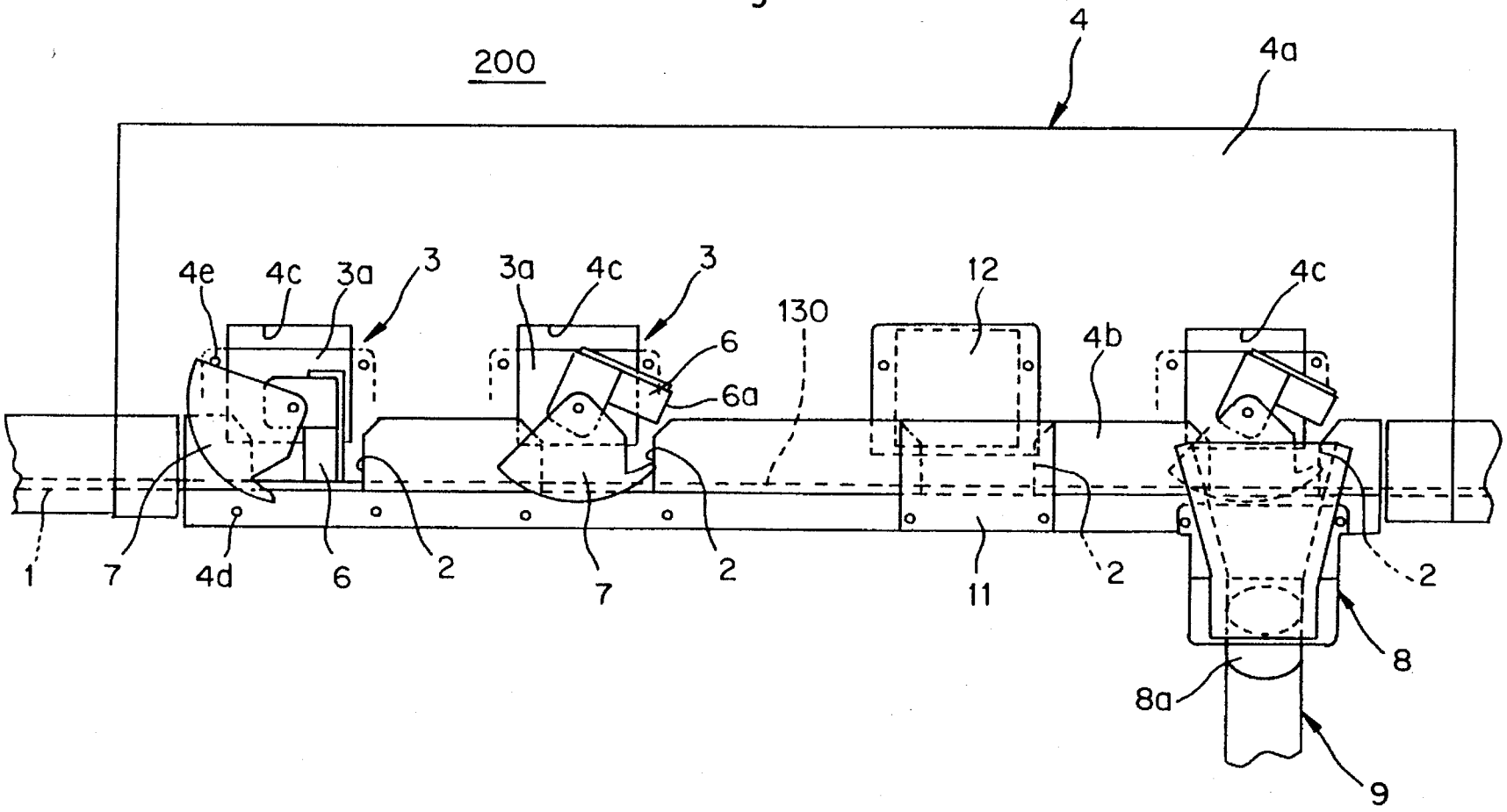
FIG. 1C is a front view showing the configuration of one embodiment of the medal distribution system of the invention.
Figure 2A:
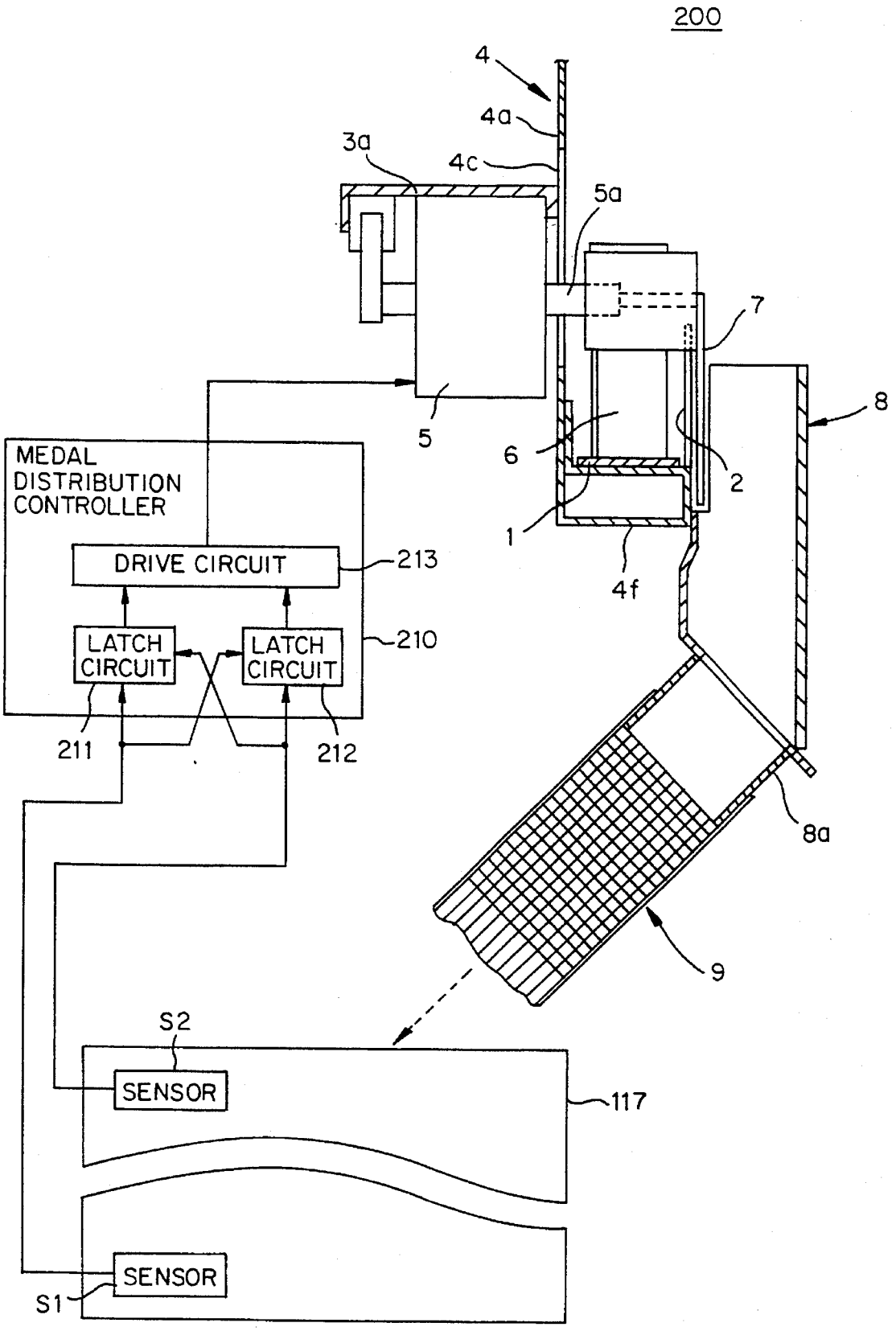
FIG. 2A is a sectional side view showing the embodiment of the invention.

Each of the slot machines 110 is provided with a gaming section 113 having rotating drums on which graphic symbols are drawn, a medal slot 112, a lever 114 for rotating the drums, stop switches 115 for stopping rotation of the drums, a tray 116 for holding medals paid out to a player for winning game plays, a management section (not shown) for managing progress of games, a dispensing control section (not shown) for controlling paying out of medals for winning game plays, a supply passage (see reference numeral 9 in FIGS. 1B and 1C) for leading medals distributed from the conveyance line 130 into a medal hopper 117 (see FIG. 1B) described below, and a medal distribution controller 210 shown in FIG. 2A and described below.

A medal lending machine 120 for lending medals to a player, as he or she inputs a bill, is installed on the side of each slot machine 110. The medal lending machine 120 has on its front a bill slot 122, a display 121 for displaying the amount of a received bill, and a dispensing tray 123 of medals paid out after change of the bill. The medal lending machine 120 contains a bill validator (not shown) for determining the denomination and validity of a received bill and a dispensing controller (not shown) responsive to a bill validation signal for controlling dispensing of medals supplied via the medal hopper 117 described below.

Three slot machines are shown in FIG. 1A; in fact, two rows of a greater number of slot machines are disposed back to back. Here, for convenience of illustration, a part in the length direction of the slot machine down is omitted.

FIG. 1B shows a medal moving path in the vertical direction in the slot machine island to which the embodiment is applied. As shown in the figure, each slot machine 110 is provided with a medal hopper 117 for holding game play medals and dispensing them. The medal hopper is communicated with the supply passage 9, the medal slot 112, a medal dispensing passage 118 leading to the tray 116, a medal lending machine passage 119 leading to the medal lending machine 120, and the gaming machine overflow passage 141.

In the slot machine island 100, the lifter 145 transports medals in the medal tank 144 located on the bottom of the island to the conveyance line 130 on the top of the slot machine island 100. The conveyance line 130 conveys the medals from one end to the opposite end. The conveyed medals are distributed by a distribution mechanism described below at the positions of the supply passages 9 communicated with the slot machines 110, as required by the slot machines 110 (containing the attached medal lending machines 120), to their respective medal hoppers 117 via the supply passages 9.

In addition, medals input through the medal slot 112 are stored in the medal hopper 117. Medals are dispensed to the tray 116 under the control of the dispensing controller (not shown) and/or to the dispensing tray 123 under the control of a dispensing controller of the medal lending machine 120. For example, when the graphic patterns on the drums match a given complete pattern, a predetermined number of medals are paid out to the tray 116 for the winning game play. If medals overflow the medal hopper 117, the medals are sent via the overflow passage 141 to the medal collection conveyor 140.

The medal collection conveyor 140 collects the medals overflowing the slot machines 110 and sends them to the medal tank 144 through the medal cleaner 150.

Thus, the medals are circulated for use in the slot machine island 100.

Next, one embodiment of a medal distribution system of the invention will be discussed with reference to the drawings.

As shown in FIG. 1C, the medal distribution system in the embodiment comprises a conveyance line 130 having a belt conveyor 1 disposed on the top of a slot machine island for transporting medals in the horizontal direction and a distribution mechanism 200. The distribution mechanism 200 comprises at least one frame 4 disposed along the belt conveyor 1, a plurality of guide mechanisms 3 fitted to the frame 4 for taking out medals transported by the belt conveyor 1 from the conveyor 1, and a plurality of supply passages 9 for leading the medals guided and discharged by the guide mechanisms 3 into slot machines 110 located under the belt conveyor 1.

In a normal slot machine island 100, a plurality of frames 4 are disposed along the belt conveyor 1. Each of the frames 4 consists of a board member **4*b* placed on the front (outside when viewed from the slot machine island), a board member 4*a* placed on the rear, and coupling members 4*f* for coupling them on the bottom (see FIG. 2A). The front board member 4*b* is provided with a plurality of discharge openings 2 lining up along the conveyor 1. The discharge openings 2 are formed as notches made on the board member 4*b*. The discharge openings 2 are used to discharge medals transported in the horizontal direction by the belt conveyor 1 to the side of the belt conveyor 1 when the medals are distributed. A plurality of the discharge openings 2 are disposed along the belt conveyor 1; four discharge openings 2 form a row on each frame 4 (only one frame 4 is shown in FIG. 1C). The number of discharge openings 2 made on one frame 4 is determined so as to be greater than that used for distributing medals. That is, it is determined to be a greater number than the number of slot machines fitted to the location of the frame 4. Therefore, the disposition pitch of the discharge openings 2** is determined so as to be made smaller than that of the slot machines.

In the frame 4, the belt conveyor 1 is passed through the space sandwiched between the board members **4*a* and 4*b*, as shown in FIG. 2A. The board member 4*a* is formed with openings 4*c* at the positions of the discharge openings 2. The guide mechanism 3 is detachably attached to the position of the opening 4*c*. Tapped holes 4*d* for detachably attaching a hopper 8 described below are provided in the vicinity of each discharge opening 2. Tapped holes 4*e* for detachably attaching the guide mechanism 3 are formed in the vicinity of each opening 4*c***.

In FIG. 1C, two supply passages 9 and hoppers 8 are omitted, but are mounted in pairs.

Figure 2B:
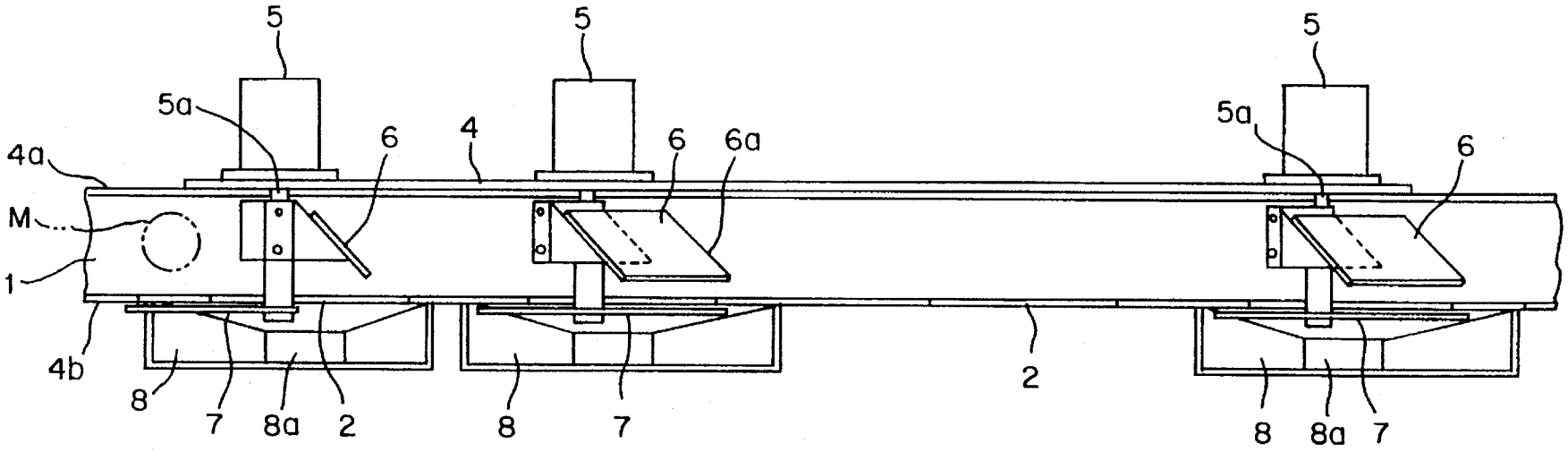
FIG. 2B is a plan view showing the embodiment of the invention.

As shown in FIGS. 1C, 2A, and 2B, the guide mechanism 3 has a rotating shaft **5*a* projecting toward the discharge opening 2 from the board member 4*a* in the space above the belt conveyor 1 at the position of the opening 4*c*, a guide plate 6 fitted to the rotating shaft 5*a* for rotating and guiding medals to the discharge opening 2 in response to the rotation position, a shutter plate 7 fitted to the rotating shaft 5*a* for rotation, when the guide plate 6 does not guide medals to the discharge opening 2, the shutter plate 7 for closing the discharge opening, an actuator 5 for driving the rotating shaft 5*a*, a support plate 3*a* detachably attached to the opening 4*c* with the tapped holes 4*e*, sensors S1 and S2 for detecting lower and upper limit quantities of medals in the hopper 117, and a medal distribution controller 210 for controlling the operation of the actuator 5** based on detection signals of the sensors.

The support plate **3*a* supports the actuator 5, so that the entire guide mechanism 3 is supported by the support plate 3*a***.

The guide mechanism 3 has two positions: A leading position for leading medals transported on the belt conveyor 1 into the discharge opening 2 and a passage position for allowing the medals to be transported on the belt conveyor 1. The guide mechanism 3 takes either of the positions in accordance with the operation of the actuator 5.

The guide plate 6, which: is made of plate material, is positioned diagonally with respect to the transportation direction of the belt conveyor 1 when the guide plate 6 takes the leading position. In the leading position, a lower edge **6*a* of the guide plate 6 is set to a near position with a slight gap on the top of the belt conveyor 1. The gap is set smaller than the medal thickness so long as the lower edge 6*a* does not come in contact with the top of the conveyor 1. In the leading position, the guide plate 6 has the lateral length (width) set to a size sufficient for coming into contact with all medals flowing on the belt conveyor 1**.

The shutter plate 7, which is made of fan plate material, is attached to the tip of the rotating shaft 5*a* with the center of the fan form aligned with the center of the rotating shaft 5*a*. The shutter plate 7 has its form and area and mount position defined so as to open the discharge opening 2 where the rotating shaft 5*a* is located when the guide mechanism 3 is set to the leading position, and to close the discharge opening 2 when it is set to the passage position.

Figure 7:
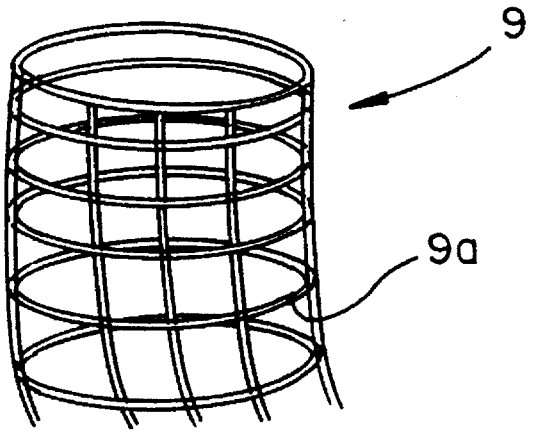
FIG. 7 is a perspective view showing the structure of a supply passage in the embodiment of the invention.

The supply passage 9 is made of a flexible tubular substance having one end linked detachably to the discharge opening 2 via the hopper 8 and the other end linked to the slot machine 110. The supply passage 9 is formed by knitting filaments 9*a* into a tube form, for example, as shown in FIG. 7. Preferably, material of the filaments 9*a* has moderate rigidity to the extent that it maintains its form, but is easily deformed upon application of a certain degree of force. (For example, copper wire or the like) The mesh size of the filaments 9*a* is made sufficiently smaller than the outer diameter of a medal.

The hopper 8 has a section like a trapezoid box. The hopper 8, which is mounted on the frame 4 with the tapped holes 4*d*, has the upper end side communicated with the discharge opening 2 and a lower end connection opening 8*a* communicated with the supply passage 9. The front of the hopper 8 is made of a transparent plate such as a transparent acrylic plate; the inside of the hopper 8 can be seen through the front plate.

On the frame 4, the discharge opening 2 and opening 4*c* to which the guide mechanism 3 :and the hopper 8 (supply passage 9) are not connected are covered with lids 11 and 12 mounted with the tapped screws 4*d* and 4*e*.

The sensor S1 detects medals in the medal hopper 117 decreasing to the lower limit quantity, and outputs a signal. The sensor S2 detects medals in the medal hopper 117 reaching a sufficient storage quantity, and outputs a signal. These sensors S1 and S2 are made of devices, such as limit switches or photo sensors.

The medal distribution controller 210, which is made up of components, such as logical circuits, controls the operation of the actuator 5 in response to the detection signals of the sensors S1 and S2. That is, the medal distribution controller 210 consists of latch circuits 211 and 212 which latch signals from the sensors S1 and S2 respectively and output high signals and are each reset by the signal to the other latch circuit from the opposed sensor, and a drive circuit 213 responsive to the output signals of the latch circuits 211 and 212 for controlling the operation of the actuator, as shown in FIG. 2A. Of course, the invention is not limited to this configuration.

Next, the operation of the embodiment is described.

When the guide mechanism 3 takes the passage position, that is, when the guide plate 6 is set to a position apart from the leading position, the shutter plate 7 closes the discharge opening 2, for example, as in the second guide mechanism 3 from the left in FIG. 1C. Thus, no medals are discharged from the discharge opening 2 for which the guide mechanism 3 is provided.

Figure 6:
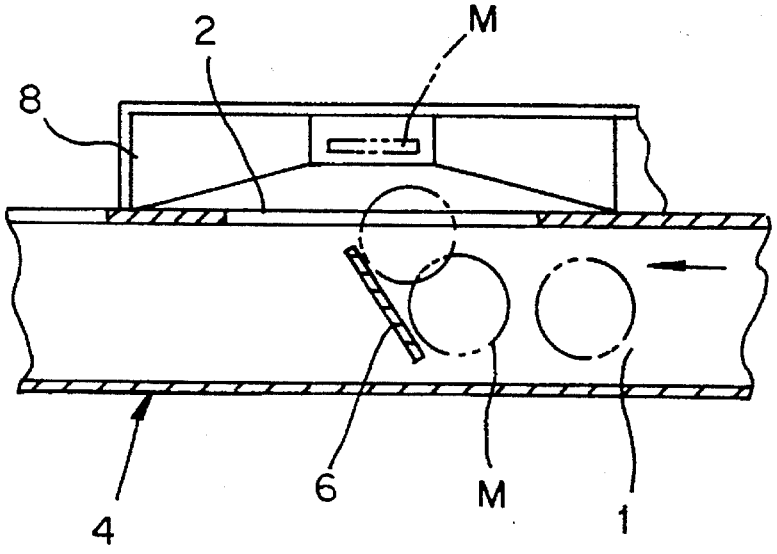
FIG. 6 is a horizontal sectional view showing the function of a guide mechanism in the embodiment of the invention.

Next, when the quantity of medals held in the medal hopper 117 decreases and the sensor S1 detects it and outputs a signal, the medal distribution controller 210 then receives the signal from the sensor S1 and the latch circuit 211 latches the signal and the latch circuit 212 is reset. Since the latch circuit 211 outputs high, the drive circuit 213 drives the actuator 5 so that the guide mechanism 3 takes the leading position. Then, the actuator 5 operates to cause the guide plate 6 to move downwards, setting the guide mechanism 3 to the leading position. Therefore, for example, as in the leftmost guide mechanism 3 in FIG. 1C, the shutter plate 7 opens the discharge opening 2 and the guide plate 6 takes a position inclining toward the transport direction with its lower edge 6*a* approaching the top face of the belt conveyor 1. In this condition, medal M transported on the belt conveyor 1, as shown in FIG. 2B, abuts against the guide plate 6, moves diagonally, and is guided to the discharge opening 2 at the position for discharging, as shown in FIG. 6.

The medal discharged through the discharge opening 2 drops, via the hopper 8 on the inside of the supply passage 9 connected to the discharge opening 2 for supply, to the specific slot machine.

Medals are thus supplied to the medal hopper 117 of the slot machine. In addition, medals input through the slot 112 are also supplied to the medal hopper 117. On the other hand, when the medal storage quantity determined by the difference between the quantity of medals dispensed to the tray 116 and the medal lending machine 120, and the quantity of medals supplied as described above increases to the position of the sensor S2, the sensor S2 detects it and outputs a signal. When the medal distribution controller 210 receives the signal from the sensor S2, the latch circuit 212 latches the signal and the latch circuit 211 is reset. Since the latch circuit 212 outputs high, the drive circuit 213 drives the actuator 5 so that the guide mechanism 3 adopts the passage position.

Thus, the guide operation of the guide mechanism 3 and the opening or closing operation of the discharge opening 2 are performed synchronously by operating the actuator 5 at the appropriate time. Medals can be supplied to a predetermined slot machine or medal lending machine at the appropriate time for ensuring distribution.

In the embodiment, the medal distribution controller 210 adopts the configuration of changing the leading and passage positions in response to the detection signals of the sensors S1 and S2, but the invention is not limited to it. For example, in response to an output of the sensor S1, the actuator 5 can be operated to set the guide mechanism 3 to the leading position and a timer or the like can be used to automatically restore the guide mechanism 3 to the passage position after a given time has elapsed.

In the embodiment, the supply passage 9, which is provided by knitting filaments 9*a* into a tube, is flexible. Thus, the supply passage 9 can be easily bent. However, the supply passage 9, which is made of a grating-shaped tube, does not produce any gap if it is bent. Thus, medals discharged into the supply passage 9 are not caught at any midpoint in the supply passage 9 and drop smoothly. Therefore, it prevents the conventional problems, such as a jam in the supply passage 9 or a bridge phenomenon, from occurring.

Moreover, in the distribution system, a greater number of discharge openings 2 than the number of the slot machines and medal lending machines are provided and the guide mechanism 3 and the supply passage 9 (hopper 8) can be attached to and detached from each discharge opening 2 and the supply passage 9 has sufficient flexibility. Therefore, the installation positions of the guide mechanism 3 and the supply passage 9 can be shifted; the flexibility of the locations of the supply passages 9 becomes extremely high.

Figure 3:
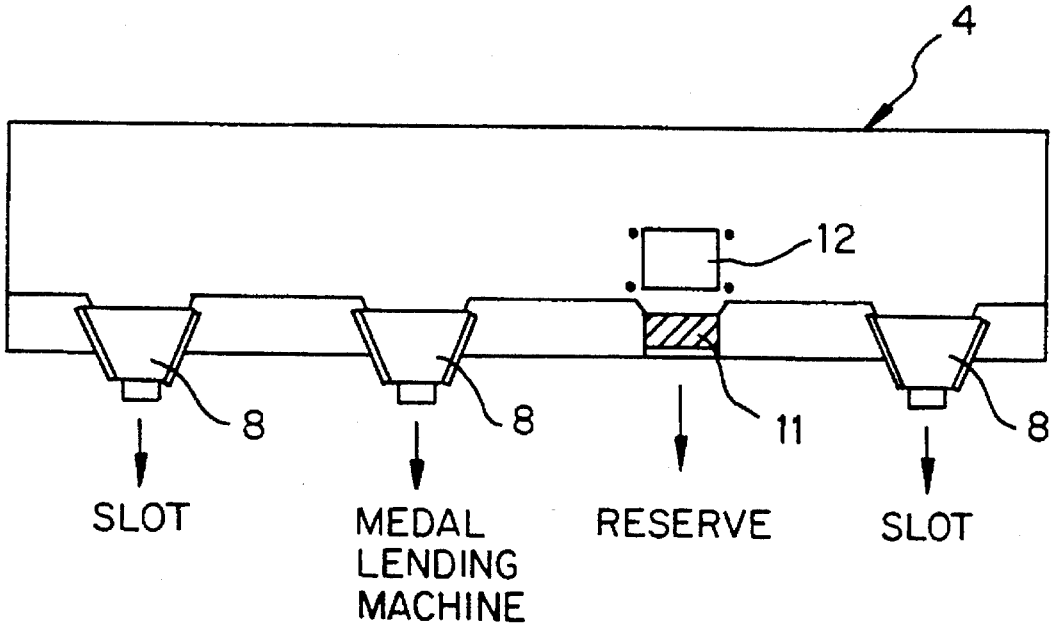
FIG. 3 is a front view showing the effect of the embodiment of the invention.
Figure 4:
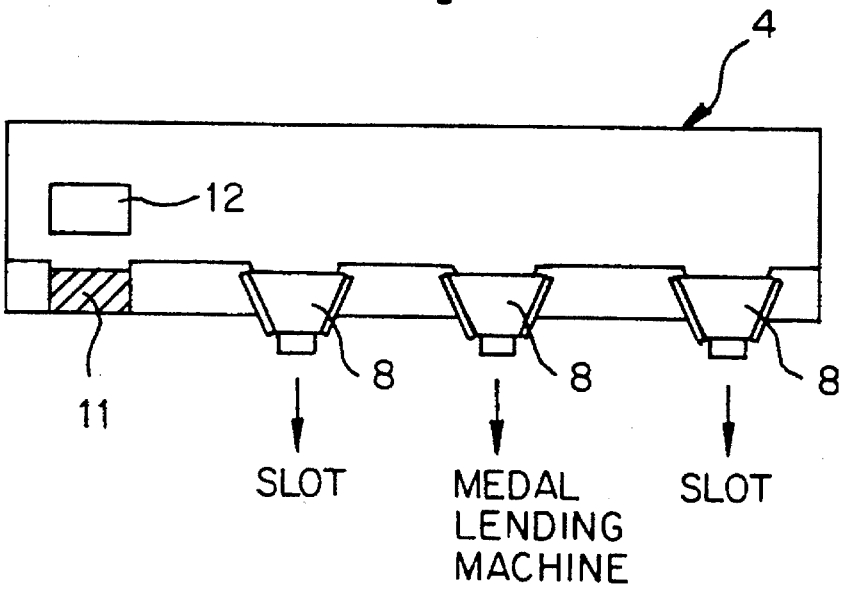
FIG. 4 is a front view showing the effect of the embodiment of the invention.
Figure 5:
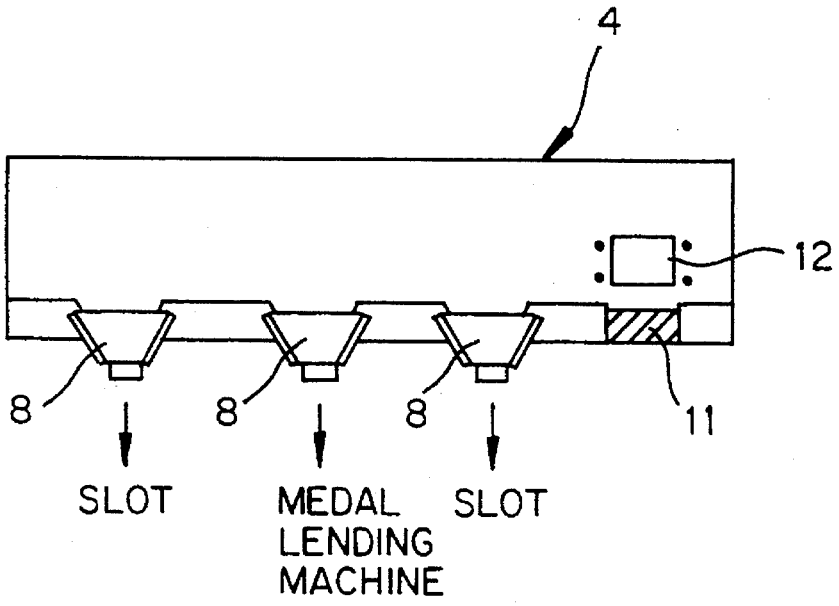
FIG. 5 is a front view showing the effect of the embodiment of the invention.

That is, the supply passage 9 for the right slot machine can be mounted (together with the guide mechanism 3 and the hopper 8) on the right end, and other supply passages can be mounted to the left, as shown in FIG. 3; all supply passages can be mounted to the left, as shown in FIG. 4; and all supply passages can be mounted to the right, as shown in FIG. 5. Since a plurality of frames 4 of the same structure are installed in a row, the supply passage for either slot machine can also be fitted to a discharge opening of the contiguous frame 4.

Thus, it becomes easy to avoid interference with other devices in the slot machine island for disposing the supply passages 9, thereby facilitating assembly of the slot machine island and modification or design change of the slot machine island.

The embodiment has the capability of ejecting foreign substances to the outside through the meshes of the filaments 9*a* and has an advantage of enabling the operator to check on the state of medal flow from the outside.

The embodiment is an example in which each slot machine is provided with a medal lending machine 120 and three slot machines are linked to one frame 4. However, the invention is not thus limited. For example, it is also applied to a slot machine island where slot machines and medal lending machines are installed independently of each other. In this example, one medal lending machine can be sandwiched between two slot machines. One medal lending machine can also be sandwiched between two and two slot machines. In either case, the supply passage 9 is linked to each of the slot machines and medal lending machines. For example, in the latter case, three pairs of guide mechanisms 3 and supply passages 9 are mounted on one frame 4 so as to distribute medals to one medal lending machine and slot machines on both sides of the medal lending machine.

In these cases, one frame is formed with a greater number of discharge openings than the number of slot machines and medal lending machines installed corresponding to the frame. For example, in the latter case mentioned above, one frame 4 is provided with as many discharge openings 2 as the number of the slot machines and medal lending machine plus one.

In the embodiment, the filaments 9*a* making up the supply passage 9 are knitted into a grating shape, as shown in FIG. 7, but the invention is not limited to this configuration. For example, the meshes may be formed like diamond shapes, needless to say.

Although medals are distributed, coins can also be used instead of medals, needless to say. Therefore, the word medal can also be taken to mean a coin throughout the specification. To use coins as medals, the medal lending machine 120 serves as a money changing machine for changing bills into coins.

According to the medal distribution system in the embodiment, the installation positions of the guide mechanism and the supply passage can be shifted. Thus, the flexibility of the locations of the supply passages becomes extremely high; it becomes easy to avoid interference with other devices in the slot machine island for disposing the supply passages. Therefore, assembly of the slot machine island becomes easy and modification or design change of the slot machine island is facilitated.

According to the medal distribution system in the embodiment, while flexibility of the supply passages is maintained, a flow of medals in the supply passages becomes extremely smooth. Thus, while adaptability of the disposition of the supply passages is maintained, smooth and secure medal distribution is enabled.

We claim:

1. A medal distribution system placed in a slot machine island where a plurality of slot machines are arranged in a row, for distributing medals to a plurality of sections in the island, said medal distribution system comprising:

a conveyance line being disposed along the row of slot machines for transporting medals in a row direction of the slot machines; and a distribution mechanism for extracting medals transported on said conveyance line from said conveyance line, said distribution mechanism having:

a frame having a plurality of discharge openings being formed on a side face of said conveyance line for extracting medals transported on said conveyance line from said line to the side;

plurality of guide mechanisms being attached to said frame for leading medals on said line out of said frame through said discharge openings; and a plurality of passages for guiding medals discharged through said discharge openings to target sections, wherein said frame has a greater number of said discharge openings than the number of said sections in the island, for distributing medals, along a transport direction of said conveyance line;

wherein each of said guide mechanisms is detachably mounted to said discharge opening, and wherein each of said guide mechanisms comprises:

a rotating shaft being mounted sideways at a position above said conveyance line and inside said discharge opening;

a guide plate being mounted on said rotating shaft for rotation, when a lower edge of said guide plate approaches a top face of said conveyance line, said guide plate abutting against a medal transported on said conveyance line for leading the medal into the discharge opening where said rotating shaft is disposed; and an actuator for driving said rotating shaft.

2. The medal distribution system as claimed in claim 1 wherein each of said guide mechanisms has a leading position where said guide plate approaches said conveyance line for leading medals into the discharge opening and a passage position where said guide plate moves away from said conveyance line for allowing medals to pass through, and maintains either of the positions.

3. The medal distribution system as claimed in claim 2 wherein each of said guide mechanisms further includes a shutter plate, said shutter plate being fitted to said rotating shaft for opening the discharge opening when said guide mechanism takes the leading position and closing said discharge opening when said guide mechanism takes the passage position in conjunction with rotation of said rotating shaft.

4. The medal distribution system as claimed in claim 3 wherein each of said guide mechanisms further includes:

sensors for detecting a quantity of medals stored in the corresponding slot machine; and a medal distribution controller for controlling driving of said actuator in order to set said guide mechanism to either of said leading and passage positions upon receipt of an output of said sensor.

5. A medal distribution system placed in a slot machine island where a plurality of slot machines are arranged in a row, for distributing medals to a plurality of sections in the island, said medal distribution system comprising:

a conveyance line being disposed along the row of slot machines for transporting medals in a row direction of the slot machines; and a distribution mechanism for extracting medals transported on said conveyance line from said conveyance line, said distribution mechanism having:

a frame having a plurality of discharge openings being formed on a side face of said conveyance line for extracting medals transported on said conveyance line from said line to the side;

a plurality of guide mechanisms being attached to said frame for leading medals on said line out of said frame through said discharge openings; and a plurality of supply passages for guiding medals discharged through said discharge openings to target sections, wherein said frame has a greater number of said discharge openings than the number of said sections in the island, for distributing medals, along a transport direction of said conveyance line, wherein, each of said supply passages comprises a flexible tubular member of knitted mesh;

wherein each of said guide mechanisms is detachably mounted to said discharge opening, and wherein each of said guide mechanisms comprises:

a rotating shaft being mounted sideways at a position above said conveyance line and inside said discharge opening;

a guide plate being mounted on said rotating shaft for rotation, when a lower edge of said guide plate approaches a top face for said conveyance line, said guide plate abutting against a medal transported on said conveyance line for leading the medal into the discharge opening where said rotating shaft is disposed; and an actuator for driving said rotating shaft.

6. The medal distribution system as claimed in claim 5 wherein each of said guide mechanisms has a leading position where said guide plate approaches said conveyance line for leading medals into the discharge opening and a passage position where said guide plate moves away from said conveyance line for allowing medals to pass through, and maintains either of the positions.

7. The medal distribution system as claimed in claim 6 wherein each of said guide mechanisms further includes a shutter plate, said shutter plate being fitted to said rotating shaft for opening the discharge opening when said guide mechanism takes the leading position and closing said discharge opening when said guide mechanism takes the passage position in conjunction with rotation of said rotating shaft.

8. The medal distribution system as claimed in claim 7 wherein each of said guide mechanisms further includes:

a sensor for detecting a quantity of medals stored in the corresponding slot machine; and a medal distribution controller for controlling driving of said actuator in order to set said guide mechanism to either of said leading and passage positions upon receipt of an output of said sensor.

* * * * *